United States Patent [19]

Mima

[11] 4,445,317

[45] May 1, 1984

[54] SPLICING METHOD FOR SPUN YARNS

[75] Inventor: Hiroshi Mima, Kyoto, Japan

[73] Assignee: Murata Kikai Kabushiki Kaisha, Japan

[21] Appl. No.: 360,062

[22] Filed: Mar. 22, 1982

[30] Foreign Application Priority Data

Mar. 26, 1981 [JP] Japan ..... 56-44967

[51] Int. Cl.[3] ..... D01H 15/00

[52] U.S. Cl. ..... 57/22; 57/261

[58] Field of Search ..... 57/22, 23, 261

[56] References Cited

U.S. PATENT DOCUMENTS

| | | | |
|---|---|---|---|
| 3,903,680 | 9/1975 | Isern | 57/22 |
| 4,263,775 | 4/1981 | Mima | 57/22 |
| 4,322,943 | 4/1982 | Rohner et al. | 57/22 X |

*Primary Examiner*—Donald Watkins

*Attorney, Agent, or Firm*—Spensley, Horn, Jubas & Lubitz

[57] ABSTRACT

An improved splicing method in which both the yarn ends to be spliced are once untwisted and then lapped and then the lapped portion of the yarn ends is subjected to the action of a compressed fluid. The length of the lapped portion arranged in a splicing hole having a jet nozzle can be changed appropriately according to kinds or count number of yarns to be processed.

6 Claims, 29 Drawing Figures

SPLICING METHOD FOR SPUN YARNS

BACKGROUND OF THE INVENTION

Among known splicing methods for spun yarns, there can be mentioned a method in which both the yarn ends to be spliced are first untwisted and then overlapped and the overlapped portion of the yarn ends are subjected to the action of a compressed fluid, whereby the yarn end portions are mingled together and fibers of both the yarn ends are entangled with one another to effect splicing.

In U.S. Pat. No. 4,263,775, I proposed a splicing method in which the splicing operation occurs in a splicing apparatus. In order to promote entanglement of the overlapped portion of two yarn ends and obtain a beautiful joint having a certain length, the yarns of the overlapped portion are untwisted to produce a condition suitable for splicing. More specifically, according to this method, each yarn end is clamped at a point a certain length from the yarn end. Both the yarn ends are sucked in suction nozzles arranged on both the sides of the splicing hole. The yarn ends are acted upon by air streams turning in the nozzles in a direction so as to untwist the yarn ends to disentange and separate fibers of the loose portions of the yarn ends. The yarns in the suction nozzles are then taken out by a yarn gathering lever and are inserted into the splicing hole.

In this method, loose parts of fibers disentangled in the suction nozzle are separated from the fiber bundle and are sucked into the nozzle. Therefore, the length of the disentangled yarn end left in the nozzle differs according to the length of fibers not removed from the yarn. More specifically, in the case of a yarn having a long fiber length, the length of the yarn end left in the nozzle is extended by the length of those fibers retained in the yarn. In the case of a yarn having a short fiber length, most of fibers are separated and the length of the yarn end left in the nozzle is shortened to that equivalent to the fibers retained as part of the yarn. Accordingly, when the yarn ends are taken out from the nozzle, the length of the untwisted and disentangled portion differs for each yarn end depending on fiber length. As a result, the length of the overlapped portion may be different for each yarn end. If the length of the overlapped portion is too long, the action of the swirling fluid stream in the splicing hole is not exerted on the loose end portion of the yarn end, resulting in formation of horny projections on both the ends of the resulting joint. These horny projections may be caught and broken by a knitting needle when the yarn is used in a knitting step to fabricate cloth. The quality of the resulting knitted fabric may thereby be degraded. If the length of the overlapped portion is too short, splicing entanglement is caused only in the extreme end portion of the yarn end where the strength of the joint is decreased.

SUMMARY OF THE INVENTION

The present invention relates to a splicing method for spun yarns and, more specifically, relates an improved splicing method in which both the yarn ends to be spliced are first untwisted and then overlapped and the overlapped portion of the yarn ends are then subjected to the action of a compressed fluid.

An object of the present invention is to provide an improved splicing method, in which by performing the operation of untwisting both the yarn ends appropriately and suffiently, prior to the splicing action the binding strength of the formed joint is increased.

According to the present invention, after both the yarn ends are introduced into a splicing hole of a splicing apparatus by a yarn gathering lever and are cut by a yarn cutting device. The yarn gathering lever which has pressed both the yarn ends against the stopper is then separated from the yarn ends and the yarn ends are drawn by suction into the control nozzles and are untwisted. Thereafter, the yarn ends are drawn farther into the control nozzles sufficiently deeply so that an untwisting operation suitable for splicing can be performed very conveniently. In this manner the binding strength of the joint can be increased and such troubles as thinning of the joint or degradation of the appearance of the joint can be effectively prevented.

DETAILED DESCRIPTION OF THE INVENTION

The present invention will now be described in detail with reference to embodiments illustrated in the accompanying drawings.

Figure 1:
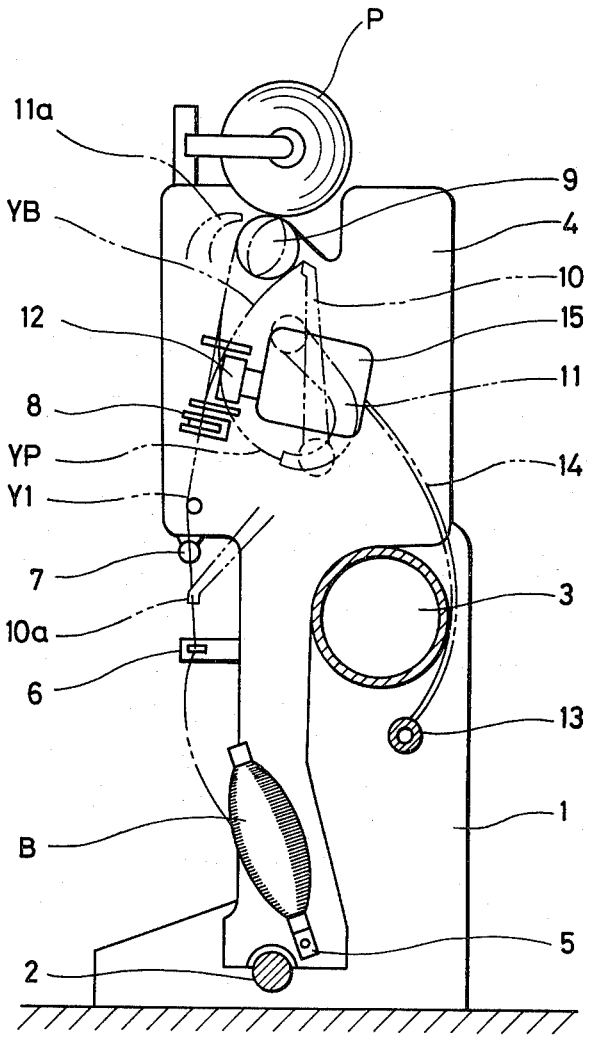
FIG. 1 is a side view diagrammatically illustrating an embodiment of an automatic winder provided with a splicing apparatus.

Referring to FIG. 1 diagrammatically illustrating an automatic winder to which the apparatus of the present invention is applied, a shaft or pipe 2 and a suction pipe 3 are laid out between two adjacent side frames 1. A winding unit 4 is turnably supported by the shaft 2 and while the automatic winder is being operated, the winding unit 4 is also placed against the suction pipe 3 and appropriately secured in this state. The pipe 3 is connected to a blower not shown in the drawings and a suction stream flows through the pipe 3.

In this winding unit 4, rewinding of a yarn from a bobbin B to a package P is accomplished in the following manner. A yarn Y1 is taken out from the bobbin B, supported on a peg 5, through a guide 6 and an appropriate tension is applied to the yarn by a tenser 7. The yarn is then passed through a detecting device 8 for performing detection of yarn unevenness such as slub. The detecting device 8 also senses breakage of the yarn and monitors the smooth running of the yarn. The yarn is then wound on the package P rotated by a winding drum 9.

When yarn unevenness is detected by the detecting device 8, a cutter arranged in the vicinity of the detecting device is actuated to cut the yarn Y1 and stop the winding operation. Simultaneously, a first yarn guide suction arm 10 is actuated to guide a yarn YB on the side of the bobbin B to a splicing apparatus 12 located at a position not in line with the normal yarn travel passage Y1. Sequentially next, a second yarn guide suction arm 11 is actuated to guide a yarn YP on the side of the package P to the splicing apparatus 12. When splicing is completed in the splicing apparatus 12, the rewinding operation is started again. The first and second yarn guide suction arms 10 and 11 are connected to the pipe 3 thereby providing sucking action which captures the yarn ends. Since a fluid such as compressed air is used for the splicing apparatus 12, a conduit 14 is connected between another pipe 13 and a splicing box 15 to supply a compressed fluid to the splicing apparatus 12 from the pipe 13.

Figure 2:
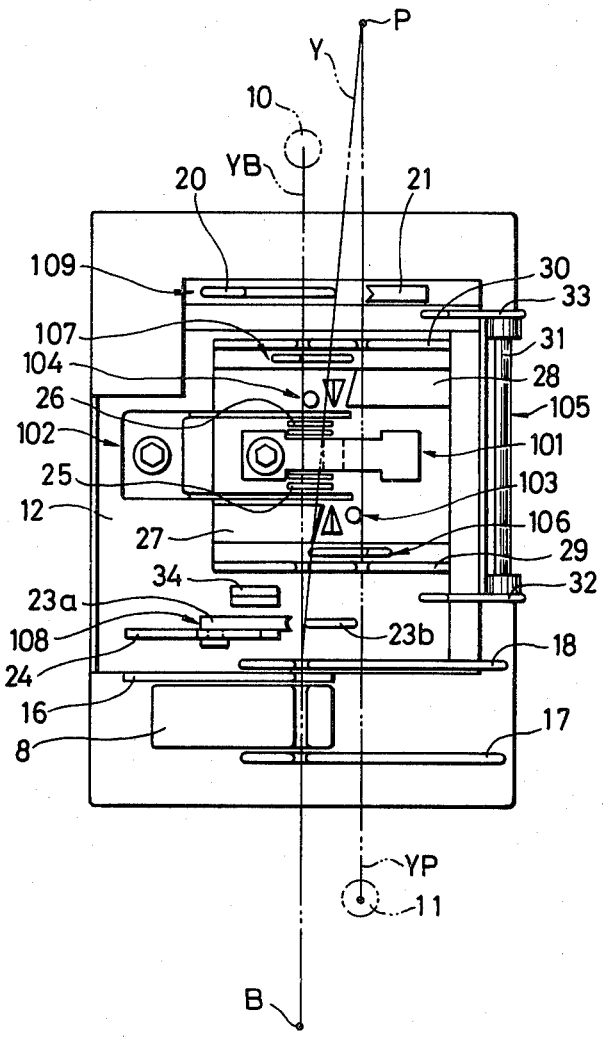
FIG. 2 is a side view of the entire structure of the splicing apparatus.
Figure 3:
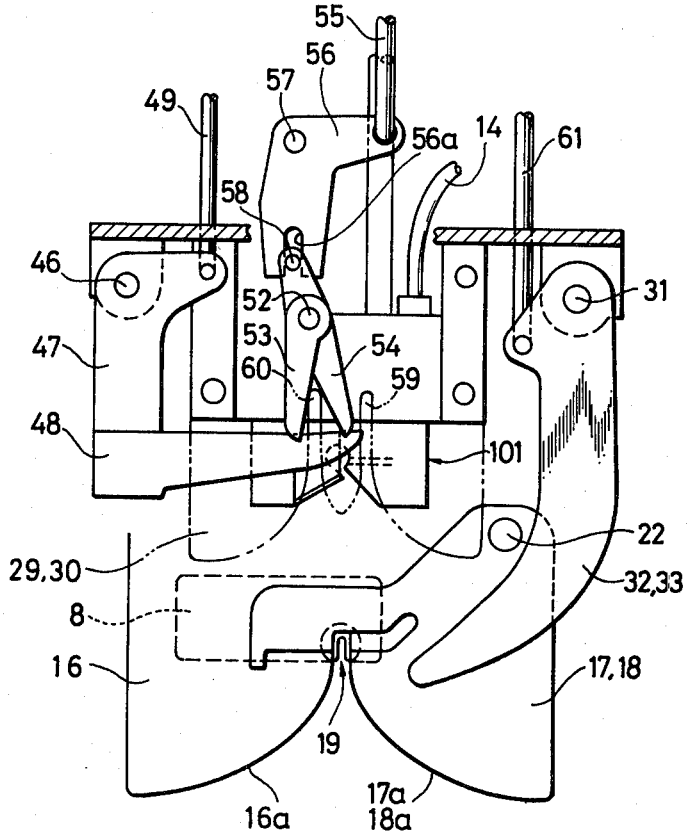
FIG. 3 is a plan view showing the splicing apparatus in a first position.

The entire structure of the splicing apparatus 12 is illustrated in detail in FIGS. 2 and 3. During the normal rewinding operation, the yarn Y is taken out from the bobbin B, is passed through a turnable guide 17, the detecting device 8, a stationary guide 16 and a turnable guide 18. The yarn then traverses the splicing apparatus 12 and is wound on the package P.

The splicing apparatus 12 comprises as basic members a splicing member 101, a yarn pressing device 102, control nozzles 103 and 104, a yarn gathering lever 105, yarn cutting devices 106 and 107 and yarn clamping devices 108 and 109. The above-mentioned first and second suction arms 10 and 11 are turned and moved so that the suction openings on the top ends of the suction arms 10 and 11 suck the yarn ends YB and YP on the sides of the bobbin B and package P. The first and second suction arms 10 and 11, retaining the yarn ends, then move to the outside of the splicing apparatus 12 and stop there.

Figure 4:
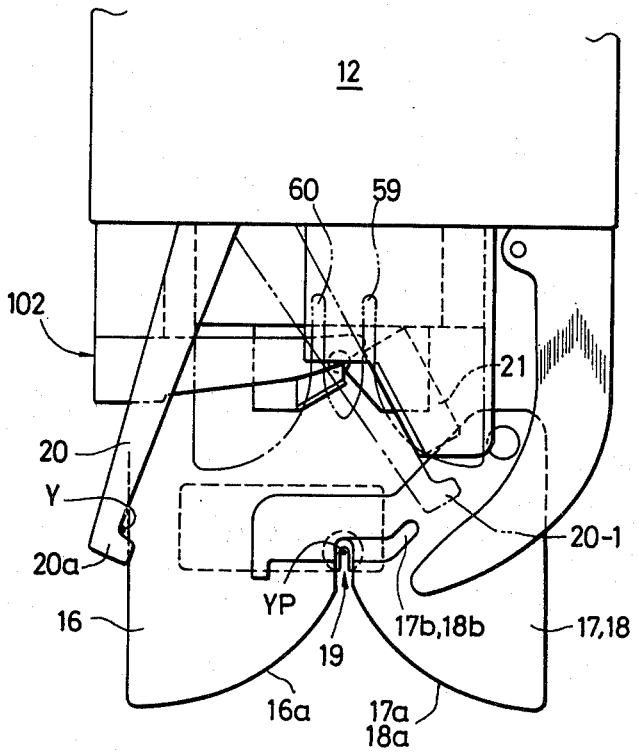
FIG. 4 is a plan view showing the splicing apparatus in a second position.

The first and second suction arms 10 and 11 are not simultaneously operated but they are operated with a certain time lag. More specifically, the yarn end YP on the side of the package P is turned to the outside of the splicing apparatus 12 by the suction arm 11. Substantially simultaneously with stoppage of the suction arm 11, a turning lever 20 of a clamping device 109 on the package P side of the splicing apparatus 12 is turned in the counterclockwise direction to a chain line position 20-1 as shown in FIG. 4 by a control cam not shown in the drawings. The turning lever 20 is brought into abutting contact with a supporting block 21 secured at a predetermined position, whereby the turning lever 20 is stopped. At this time, the yarn Y is moved into a position where the yarn Y is caught on a hook 20*a* of the turning lever 20 and the yarn Y is gripped between the supporting block 21 and the turning lever 20.

Figure 5:
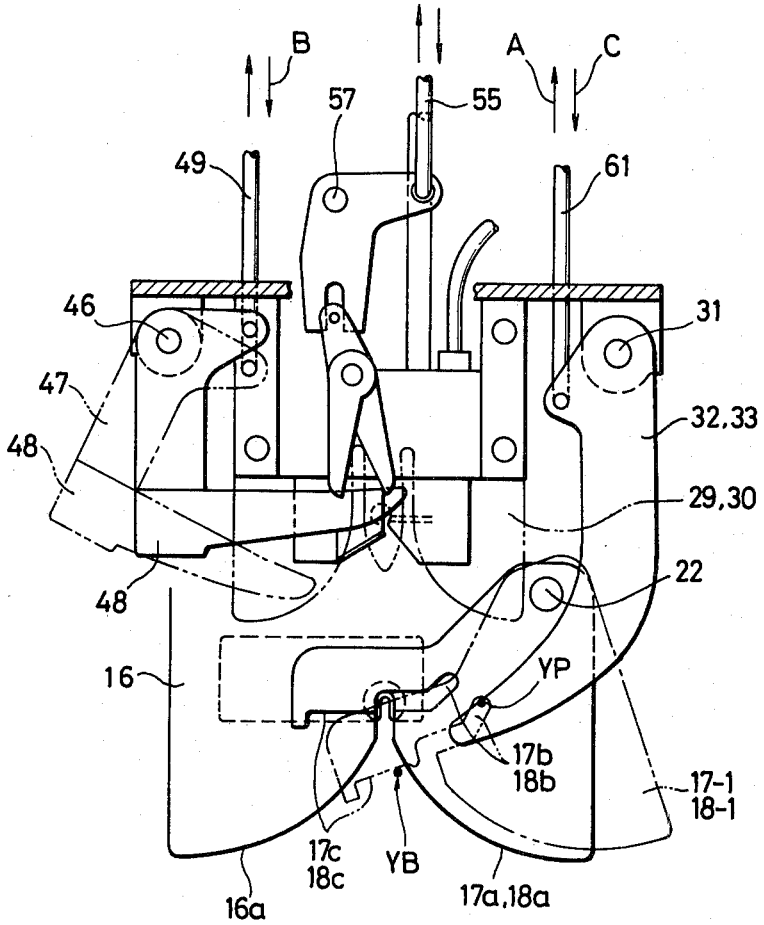
FIG. 5 is a plan view showing a third position of splicing apparatus.

While turning lever 20 is being operated, the yarn Y located on the stationary guide 16 and turning guides 17 and 18 is inserted in a guide groove 19 along inclined faces 16*a*, 17*a* and 18*a* of the guides 16, 17 and 18. A check of the absence or presence of the yarn Y or detection of erroneous suction of two or more of yarns by the suction arm 11 is performed by the detecting device 8 arranged along the same yarn path as that established by the guide groove 19. After confirmation of the presence of the yarn Y, the turning guides 17 and 18 are turned by a control cam, not shown in the drawings, in a counterclockwise direction with a supporting shaft 22 serving as the fulcrum as shown in FIG. 5. As a result of this turning of the turning guides 17 and 18, the yarn end YP is separated from the detecting device 8 and is inserted into escape grooves 17*b* and 18*b* of the turning guides 17 and 18.

Substantially simultaneously with the turning movement of the turning guides 17 and 18, the yarn end YB on the side of the bobbin B is sucked by the suction arm 10, and the suction arm 10 is turned in the direction opposite to the turning direction of the suction arm 11 and is moved to the outside of the splicing apparatus 12 and stopped there. Substantially simultaneously upon the stopping of turning of the suction arm 10, a supporting plate 23*a* of the yarn clamping device 108 is turned by a control cam, not shown in the drawings, along a guide plate 24 in the same direction as a turning direction of the turning lever 20, into a position where the yarn is hung thereon. The supporting plate 23*a* is stopped on abutting contact with a supporting block 23*b* secured at a predetermined position, whereby the yarn Y is gripped between the supporting plate 23*a* and the supporting block 23*b*. At this time, as shown in FIG. 5, the yarn YB is hung on hooks 17*c* and 18*b* formed in the vicinity of the top ends of the turning guides 17 and 18 by the turning movement of the guides 17 and 18. Checking of the yarn YB in the detecting device 8 is performed after completion of the splicing operation.

The splicing member 101 is arranged substantially at the center of the splicing apparatus 12. Within the splicing member 101, in following a path from the bobbin B to the package P, there are arranged in sequence, a fork guide 29, a yarn cutting device 106, a yarn guide 27, a control nozzle 103, a first portion of a pressing device 102, a yarn guide pen 25, the splicing member 101, a yarn guide pin 26, a second portion of the pressing device 102, a control nozzle 104, a second yarn guide 28, a second yarn cutting device 107, and a second fork guide 30. A yarn gathering lever 105 comprising a supporting shaft 31 and levers 32 and 33 turning about the shaft 31 is located to one side of the splicing apparatus 12. After the detecting device 8 detects slub or other unevenness of the yarn y, a slub cutter not shown in the drawings is actuated to cut the yarn. The suction arms 10 and 11 are then operated to guide the yarn ends YP and YB to the outside of the splicing apparatus 12, the yarn gathering lever 105 guides the yarn ends YP and YB towards the splicing apparatus 12. The turning range of the yarn gathering lever 105 is adjusted so that the yarn gathering lever 105 is stopped on abutting contact with a stopper 34. The stopper 34 has a substantially V-shaped section, and is located between the fork guide 29 and the yarn clamping device 108. Accordingly, the turning range of the yarn gathering lever 105 can be varied by adjusting the position of the stopper 34.

The respective members and devices will now be described in detail one by one.

Referring to FIGS. 6 through 9, the splicing member 101, arranged substantially at the center of the splicing apparatus 12, is secured to a bracket 35 by means of a screw 36. A cylindrical splicing hole 37 is formed substantially at the center of the splicing member 101 and a slit 38 for insertion of the yarn Y from the outside is formed entirely along the length of the splicing hole 37. Furthermore, a jet nozzle hole 39, opened to the splicing hole 37 in the tangential direction, is formed.

Balloon control plates 42 and 43 are screwed to both the sides of the splicing member 101 through spacers 40 and 41. The control plate 42 is arranged to cover about half of the sectional area of the splicing hole 37.

The control plate 42 has an effect of controlling a balloon formed by the action of a compressed fluid such as air jetted from the jet nozzle hole 39 during the actual splicing operation. When the compressed fluid impinges against the walls of the control plates 42 and 43, the amount of the fluid flowing toward the slit 38 is increased to cause the yarn Y to fly out. In order to prevent occurrence of this undesirable phenomenon, the spacers 40 and 41 are included. More specifically, spacers 40 and 41 are arranged to form spaces between walls 44 and 45 of the splicing member 101 and the control plates 42 and 43, whereby the amount of the fluid flowing out from the slit 38 is controlled. The compressed fluid is supplied to the jet nozzle hole 39 through the above-mentioned conduit 14.

Figure 10:
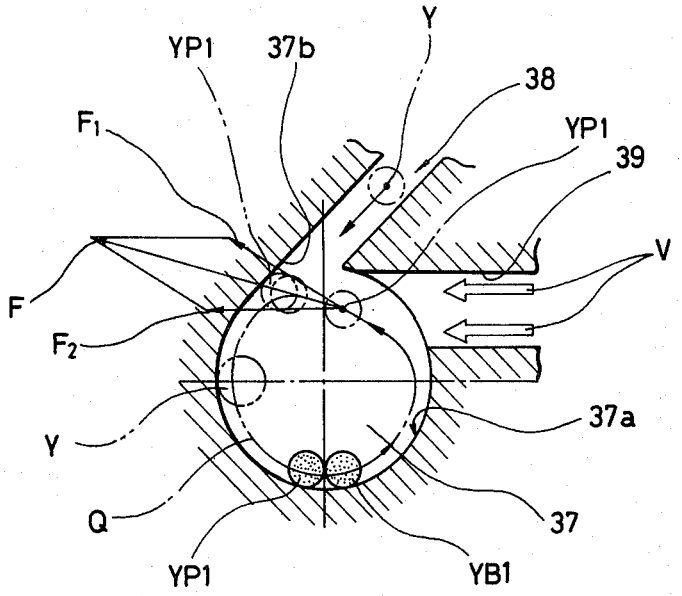
FIG. 10 is a diagram showing the fluid flow within the splicing hole.
Figure 11A:
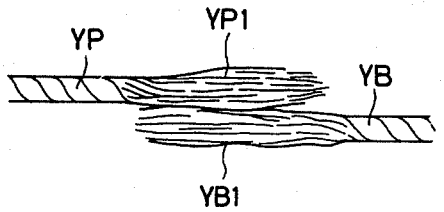
FIGS. 11*a*, 11*b*, 11*c* and 11*d* respectively show diagrams of the overlap of untwisted yarn ends, the integration of yarn ends, the entangling to form a splice, and the formation of a balloon.
Figure 11B:
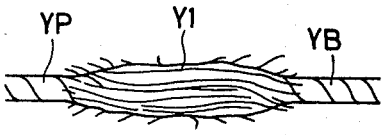
Figure 11C:
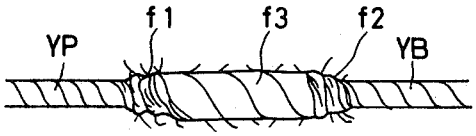
Figure 11D:
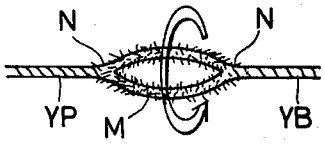
Figure 12:
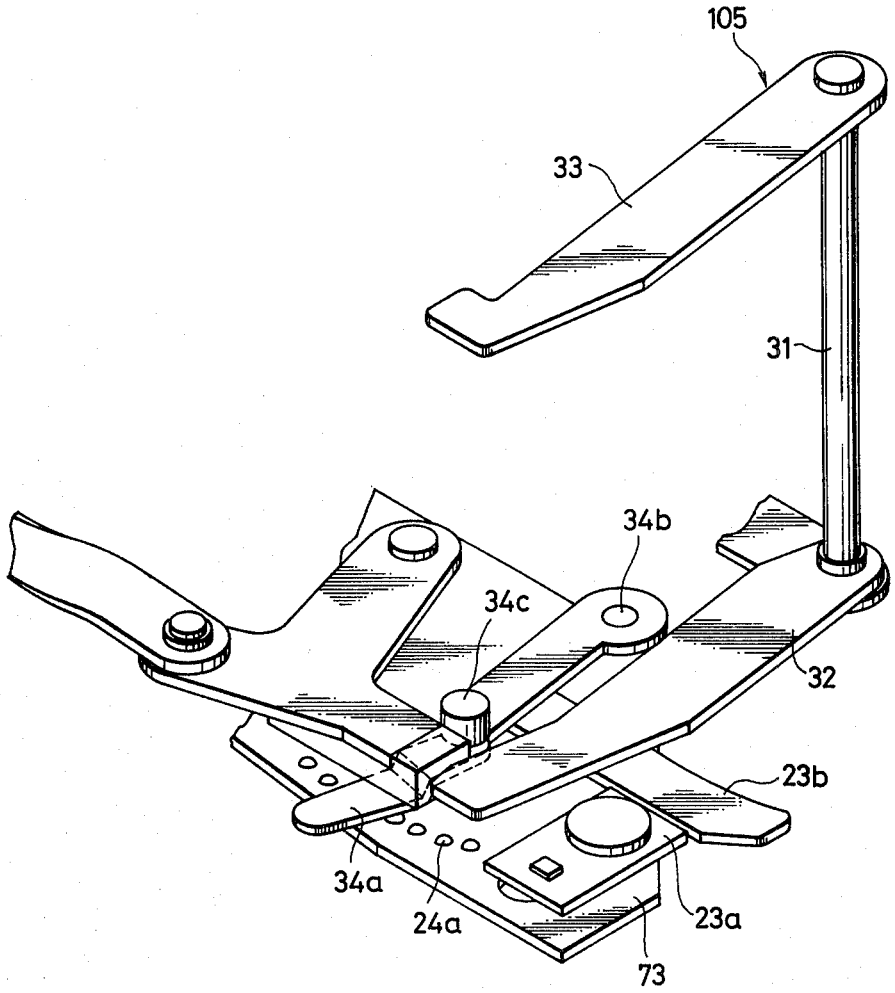
FIG. 12 is a perspective view showing a yarn gathering lever and a stopper.

The method of forming a joint by splicing is illustrated in FIGS. 10 through 12. The yarn end YB from the bobbin B and the yarn end YP from the package P, which are to be spliced together, are inserted through the slit 38 into the splicing hole 37 and generally positioned as to be in contact with the inner circumferential face 37*a* of the splicing hole 37 at the position substantially opposite the opening of the slit 38 of the splicing hole 37. If a compressed fluid V is jetted within the splicing hole 37 in this state, the fluid V tends to flow along the inner circumferential surface 37*a* of he splicing hole 37. When the fluid has traversed about ½ of the circumference in the splicing hole 37, the fluid catches both the yarn ends YB1 and YP1 and continues the turning movement.

When the fluid has made substantially one round, the turning fluid F1 joins with a fluid F2 subsequently jetted and a joined flow F of the turning fluid F1 and jetted fluid F2 is formed.

At this time, the yarn ends YB1 and YP1 to be spliced are moved along locus Q of the above-mentioned fluid, and when the yarn ends YB1 and YP1 arrive at the point where the turning fluid F1 joins with the jetted fluid F2, the yarn end YB1 is first caused to abut against the inner circumference 37*b* of the splicing hole 37 slightly inwardly of the opening of the slit 38 and the yarn end YP1 is caused to impinge against the yarn end YB1. At this point, both the yarn ends YB1 and YP1 tend to become entangled and integrated with each other. This operation of entangling and integrating both the yarn ends with each other should be performed at the initial stage of the turning movement of the yarn ends. As the yarn YL formed by integration of the yarn ends YB1 and YP1 is turned, twists are given to the yarn YL. Moreover, entanglement is caused on both the ends of the twisted portion and the integration of the yarn ends becomes difficult after the yarn ends have been rotated and turned for a certain time.

More specifically, before the yarn ends YB1 and YP1 to be spliced are guided into the splicing hole 37, the yarn ends YB1 and YP1 are untwisted by the splicing control nozzles 103 and 104 described hereinafter. As shown in FIG. 11-*a* all the fibers are arranged substantially in parallel to one another. Then, as shown in FIG. 11-*b*, both the yarn ends YP1 and YB1 are integrated at the point where the turning fluid flow F1 joins with the fluid flow F2 jetted from the jet nozzle 39. Then, the fibers of both the yarn ends are tightly entangled with one another by the action of the turning fluid stream and twists f3 are given between both the entangled portions f1 and f2, as shown in FIG. 11-*c*.

When the jetted fluid V is applied to the yarn ends YP1 and YB1, as shown in FIG. 11-*c*, a balloon M is formed, and if the rotation number of the balloon is increased, the respective fibers in the vicinity of the balloon neck N become untwisted and unentangled and yarn breakage is readily caused in this portion. Accordingly, the rotation number of the balloon is controlled to a level suitable for the splicing operation by the above-mentioned balloon control plates 42 and 43.

Figure 6:
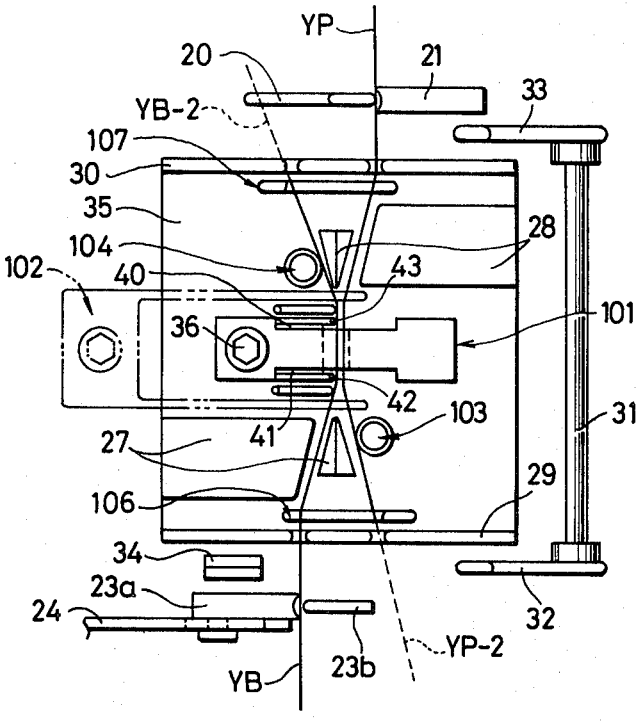
FIG. 6 is a side view showing greater detail of the splicing apparatus.
Figure 7:
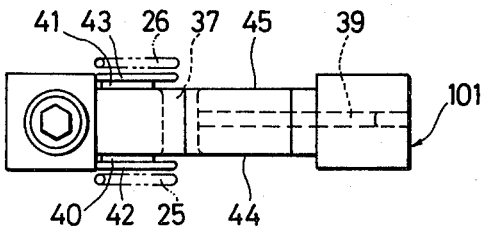
FIG. 7 is a plan view showing a splicing member.
Figure 8:
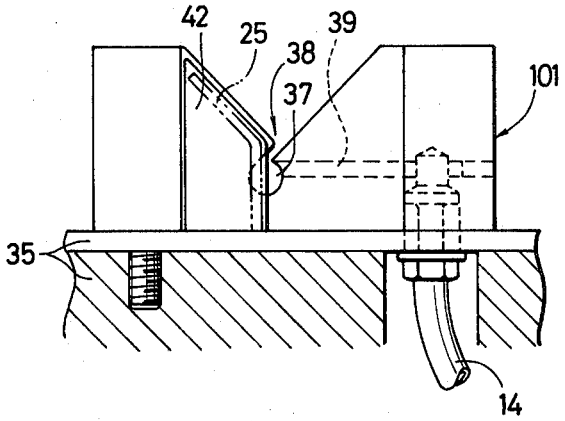
FIG. 8 is a side view of the splicing member.
Figure 9:
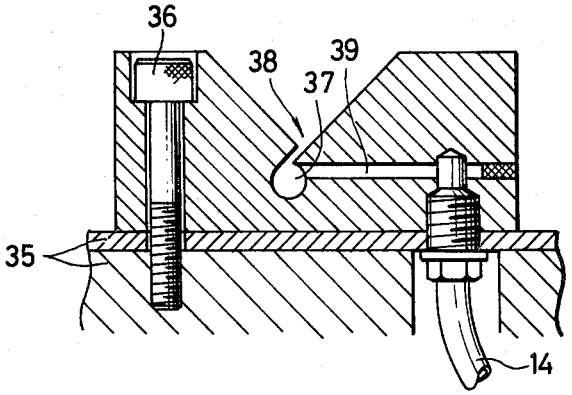
FIG. 9 is a sectional view of the splicing member.

Referring to FIGS. 6 and 7, the pressing device 102 co-operates with turning of the yarn gathering lever 105 during the splicing step to take out the yarn ends YP1 and YB1 untwisted by the splicing control nozzles 103 and 104 and set them within the splicing hole 37. Simultaneously, the pressing device 102 controls the positions of both the yarns YP and YB. In the pressing device 102, a pressing plate 48 is screwed to a turning lever 47 rotating about a supporting shaft 46. If a rod 49 is operated by a control cam not shown in the drawings, the pressing plate 48 is turned as shown in FIG. 5.

The relation between the yarn gathering lever 105 and the stopper 34 is illustrated in FIG. 12. An auxiliary stopper 34*a* is arranged rotatably around a fulcrum 34*b*, and the lower face of the auxiliary stopper 34*a* is brought in engagement and sliding contact with small projections formed on the guide plate 24, so that the position of a stopper pin 34*c* can optionally be changed within a certain range. The supporting plate 23*a* of the yarn clamping device 108 abuts against the supporting block 23*b* to grip the yarn Y. Then the yarn gathering lever 105 is turned and is stopped when the lever 32 abuts against the stopper 34. The yarn gathering lever 105 is then rotated away during the cutting step. At the splicing step, the yarn gathering lever 105 is turned again to take out the yarn YP and YB from the control nozzles 103 and 104. At this time, the stopper 34 is located at a retreated position by the action of cams, and the lever 32 is stopped when it abuts against the stopper pin 34C of the auxiliary stopper 34*a*, the position of which has been adjusted in advance. Namely, by adjusting the position of the auxiliary stopper 34*a*, the length of the overlapped portion of the yarn ends YP1 and YB1 in the splicing hole 37 of the splicing member 101 can be changed to readily adjust the splicing length.

Figure 13:
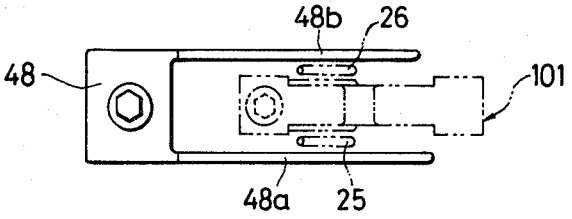
FIG. 13 is a side view showing a clamping plate in detail.
Figure 14:
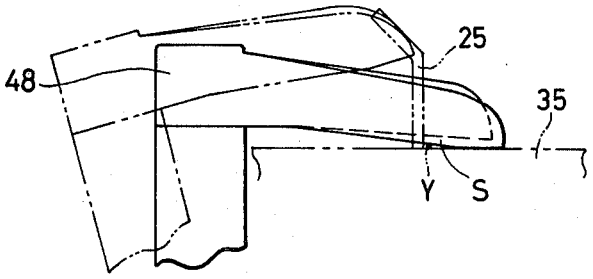
FIG. 14 is a plan view showing the clamping plate in detail.

The yarn pressing plate 48 is illustrated in detail in FIGS. 13 and 14. The pressing plate 48 has forked pieces 48*a* and 48*b* which extend substantially across the splicing member 101. These forked pieces have shapes which differ from each other. When the pressing plate 48 is turned and one forked piece 48*a* falls in abutting contact with the face of the bracket 35 to press the yarn Y between the top face of the bracket 35, the yarn guide pin 25 and the forked piece 48*a*, a certain space S allowing passage of the yarn Y is formed between the other forked piece 48*b*, the top face of the bracket 35 and the yarn guide pin 26, whereby the position control is effected only in the direction traversing the yarn Y at a right angle.

The yarn pressing action of the forked piece 48*a* of the pressing plate 48 is performed to prevent communication, to the balance of the yarn, of twists caused during balloon formation on the yarn ends YB1 and YP1 by the action of the compressed fluid as described hereinbefore.

Accordingly, the degree of this pressing action is controlled to such an extent that twists on the yarn Y are not released by the action of the balloon. If this pressing action is too strong, on the other hand, fluffs are formed and unacceptable yarn can be obtained. Since the other yarn Y is rotated in the direction of its twist by the action of the balloon, this yarn need not particularly be held and it is sufficient if this yarn Y is pressed only to such a degree that the position thereof is controlled.

Figure 15:
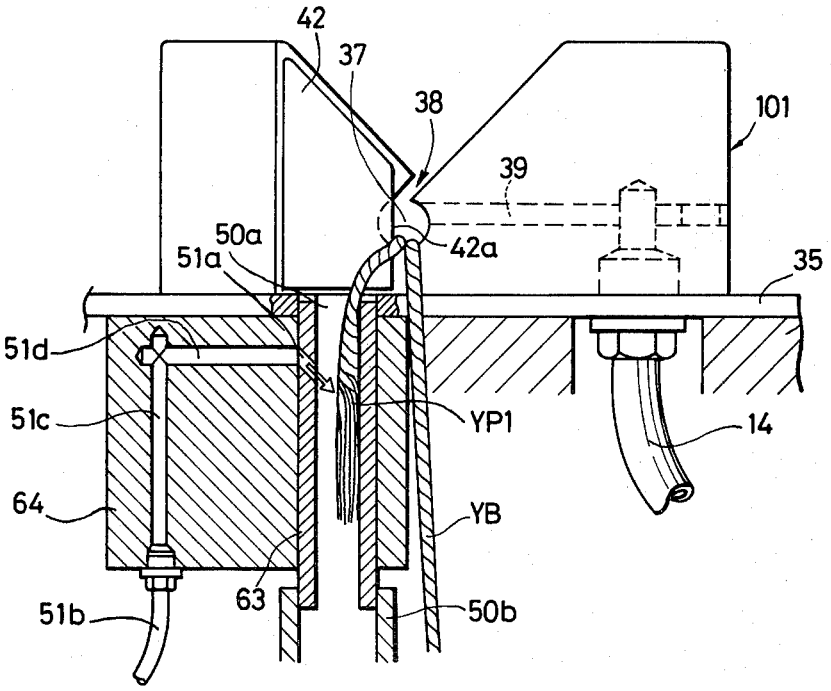
FIG. 15 is a longitudinally sectional view showing the entire structure of a control nozzle.

As shown in FIG. 15, a nozzle hole 50*a* for untwisting the yarn ends YB1 and YP1 is formed on the yarn control nozzles 103 and 104 located one on each side of the pressing device 102. The yarn end YB1 on the side nearest the bobbin B and the yarn end YP1 on the side nearest the package P, which are to be spliced together, are guided into their appropriate nozzle hole 50*a* through the yarn splicing hole 37. Introduction of the yarn ends YB1 and YP1 is accomplished by the sucking action of the above-mentioned suction pipe 3 through a flexible pipe 50*b*. When the yarn end YP1 is guided into the nozzle hole 50*a*, a fluid is jetted from a jet nozzle 51*a* opened obliquely to the nozzle hole 50*a* to untwist the yarn end YP1 and arrange the respective fibers in parallel to one another.

Figure 16A:
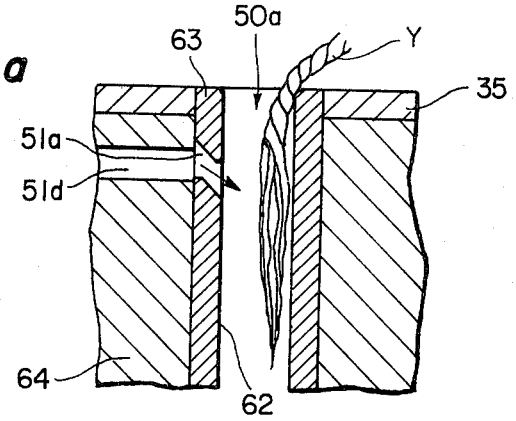
FIGS. 16*a*, 16*b* and 16*c* respectively show the differing lengths of yarn end untwisting occuring dependent on positioning of the sleeve within the control.
Figure 16B:
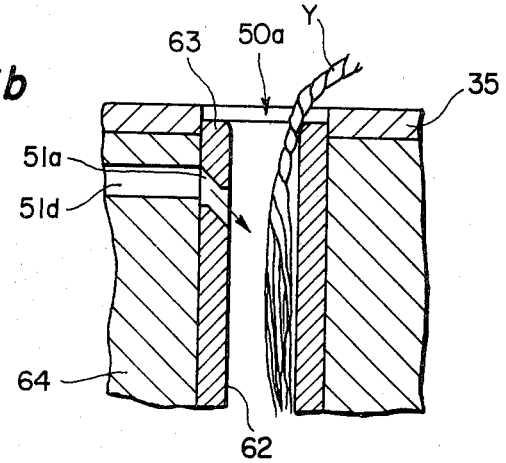
Figure 16C:
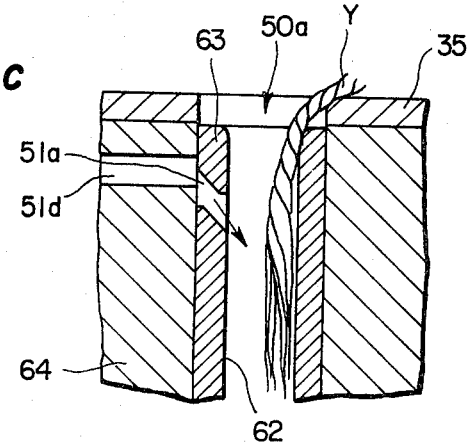

As shown in FIG. 16, a sleeve 63 forming the jet nozzle 51*a* is adapted so that it can advance and retreat within the nozzle hole. The untwisting length and untwisting degree are changed by the position of the sleeve 63 in the nozzle hole 50*a*. For purposes of illustration, consider that the state shown in FIG. 16-*b* provides normal untwisting of the yarn. If the sleeve 63 is inserted in a relatively shallow manner as shown in FIG. 16-*a*, the position of the jet nozzle 51 becomes too close to the position of the nozzle hole 50*a* and the jetted fluid impinges against relatively upper parts of the yarn ends YP1 and YB1, with the result that the untwisting length is increased and the tops of the yarn ends are entangled and become thin. If the splicing operation is carried out in this state, the appearance of the formed joint is degraded and fiber balls are readily formed. If the sleeve 63 is inserted deeply as shown in FIG. 16-*c*, the jet nozzle 51*a* is greatly separated from the nozzle hole 50*a*, and the jetted fluid impinges against the tops of the yarn ends YP1 and YB1, with the result that the untwisting length is short and the strength or size of the formed joint is reduced after the splicing operation. Accordingly, the depth of the sleeve is adjusted appropriately according to the kind and count number of the yarn to be spliced so that an appropriate untwisted state is produced.

Figure 17:
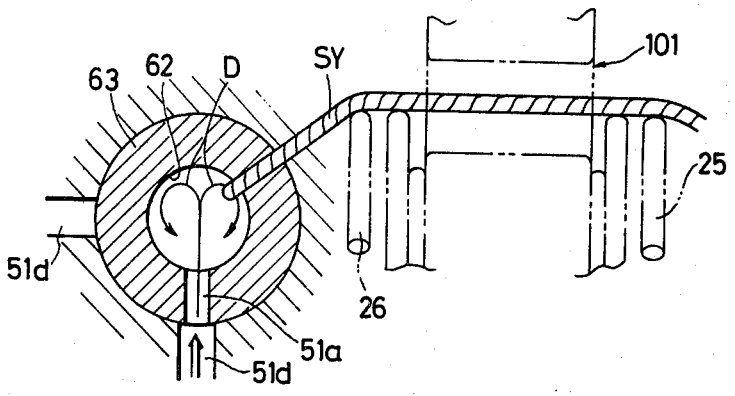
FIG. 17 is a vertical sectional view of the control nozzle, showing sleeve orientation for SY twisted yard.
Figure 18:
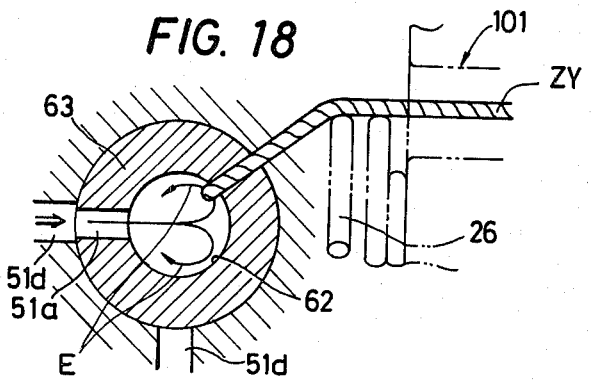
FIG. 18 repeats FIG. 17 with the sleeve oriented for a ZY twisted yarn.
Figures 19A, 19B:
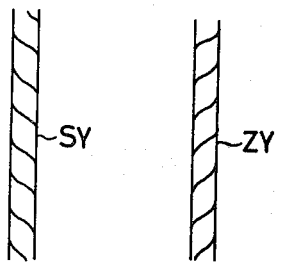
FIGS. 19*a* and 19*b* are diagrams showing the twisting directions in yarn.

Referring to FIGS. 16 through 18 illustrating the nozzle hole 50*a* in detail, the end of yarn Y is freely and unrestrictedly inserted into a suction hole 62 where it is untwisted by a compressed fluid jetted from the jet nozzle 51*a* opened obliquely through the sleeve 63. However, since the twists given to the yarn Y may be either Z twists or S twists as illustrated by FIGS. 19-*a* and 19-*b* and the twisting directions of these two kinds of twists are opposite to each other, the jetting direction of the jet nozzle 51*a* should be adjusted appropriately according to the twisting direction of the twists on the yarn Y. More specifically, in the case of an S-twisted yarn SY, the turning flow of the fluid jetted from the jet nozzle 51*a* should be caused in the direction of arrow D in FIG. 17 so as to untwist the yarn SY. In the case of a Z-twisted yarn ZY, the turning flow should be caused to act in the direction of arrow E in FIG. 18, that is, in the direction opposite to the direction in case of the S-twisted yarn. In order to realize this feature, a communication hole 51*d* communicated with the jet nozzle 51*a* of the sleeve 63 is formed on a supporting block 64 rotatably supporting the sleeve 63 with a deviation of about 90°, and by rotating the sleeve 63 by about 90°, either S twists or Z twists can be released.

There may be adopted a modification in which the jet nozzle 51*a* is formed tangentially to the suction hole 62 so that a turning fluid flow acting in the direction opposite to the twisting direction of the yarn is formed. Moreover, there may be adopted another modification in which the jet nozzle 51*a* as described above is not formed but a spiral groove or spiral vane is formed on the inner wall of the suction hole 62 and a turning flow is produced by the sucking action of the flexible pipe 50*b*. In this modification, the spiral direction of the spiral groove or spiral vane is established according to the twisting direction of the yarn Y.

Incidentally, the above-mentioned nozzle hole 50*a* is effective for promoting untwisting of the yarn Y, but in principle, the intended effect can be attained only if the sucking action of the flexible pipe 50*b* does not cause a turning flow. The fluid is supplied from the pipe 13 connected through the above-mentioned conduit 14 via a conduit 51*b* and communication holes 51*c* and 51*d*.

Incidentally, in the foregoing embodiment, the fluid jetting action of the jet nozzle 51*a* and the sucking action of the flexible 50*b* are simultaneously performed. However, there may be adopted a modification in which only the compressed fluid jetting action of the jet nozzle 51*a* is performed.

Referring to FIGS. 2 and 3, the cutting devices 106 and 107 have a scissor-like shape, and in each cutting device, a movable blade 54 is rotated about a stationary pin 52 so that the movable blade 54 intersects a stationary blade 53, whereby the yarn Y is cut. When a rod 55 is actuated by a control cam not shown in the drawings, a bifurcate lever 56 is turned in the clockwise or counterclockwise direction about a shaft 57, and a fork-like portion 56*a* of the lever 56 moves a supporting pin 58 on the other end of the movable blade 54, whereby the movable blade 54 is caused to rotate about shaft 52.

Fork guides 29 and 30 are arranged outwardly of the yarn cutting devices 106 and 107, and guide grooves 59 and 60 are formed on the fork guides 29 and 30, respectively.

The yarn gathering lever 105 arranged in the side portion of the splicing apparatus 12 is turned in the clockwise direction about a shaft 31 to introduce the yarns YP and YB into guide grooves 59 and 60. This motion occurs when a rod 61 is operated by a control cam not shown in the drawings.

The operation of the splicing apparatus having the above-mentioned structure will now be described.

Referring to FIG. 1, when the detecting device 8 detects a breakage or other interruption of the yarn being rewound, the drum 9 is stopped. Simultaneously, a one-way clutch not shown in the drawings is actuated and the splicing operation is performed by various control cams arranged on a shaft rotated through said clutch or by various control cams co-operating with said shaft.

At first, the first and second yarn guide suction arms, sucking the yarn ends, are turned and moved from the chain line positions 10*a* and 11*a* shown in FIG. 1. They pass above the splicing apparatus 12 in such a manner that the yarn YB from the side nearest the bobbin B and the yarn YP from the side nearest the package P intersect each other. Then, the suction arms are guided to the outside of the splicing apparatus 12 and are stopped there.

As pointed out hereinbefore, the motions of the first and second suction arms are not simultaneously performed. First, the yarn YP from the side nearest the package P is captured by the suction arm 11 which is then turned to the outside of the splicing apparatus 12 and stopped at that position. After passage of a predetermined time, the yarn YB from the side nearest the bobbin B is captured by the suction arm 10 which is then turned to the outside of the splicing apparatus 12 and stopped at that location.

During the predetermined time from the actuation of the second suction arm 11 to the actuation of the first suction arm 10, as shown in FIGS. 4 and 5, the turning lever 20 of the clamping device on the side nearest the package P is operated to grip the yarn YP between the turning lever 20 and the supporting block 21. Simultaneously, the yarn YP is introduced into the guide groove 19 of the stationary guide 16 and turning guides 17 and 18 arranged in the vicinity of the detecting device 8 and detection is performed by the detecting device 8. Then, the turning guides 17 and 18 are turned about the shaft 22 to the chain line positions 17-1 and 18-1 to separate the yarn YP from the detecting device 8 and to insert the yarn YP into the escape grooves 17*b* and 18*b*.

Then, the first suction arm 10 sucks the yarn YB on the side nearest the bobbin B, and is turned to the outside of the splicing apparatus 12 and stopped there. At this time, the yarn YB is passed through the hook portions 17*c* and 18*c* of the turning guides 17 and 18 and is gripped between the supporting plate 23*a* and supporting block 23*b* of the clamping device 108 as shown in FIG. 6. Accordingly, detection of the yarn YB on the side of the bobbin B by the detecting device 8 is not performed before the splicing operation but is performed after completion of the splicing operation.

When the above-mentioed operations of the first and second suction arms 10 and 11 are completed, the levers 32 and 33 of the yarn gathering lever 105 shown in FIGS. 2 through 6 are rotated about the shaft 31 and both the yarns YB and YP are guided into the guide grooves 59 and 60 of the fork guides 29 and 30, respectively, and are inserted into the splicing hole 37 of the splicing member 101 through the slit 38.

Then, the yarn ends are cut at positions YB-2 and YP-2, which are separated by predetermined distances from the yarn supporting devices 108 and 109, by the cutting devices 106 and 107 as shown in FIG. 6. The yarn-cutting positions have a relation to the length of the formed joint and have influences on the appearance, touch and binding strength of the joint. The yarn-cutting positions are appropriately adjusted according to the count number of the yarn.

Figure 20:
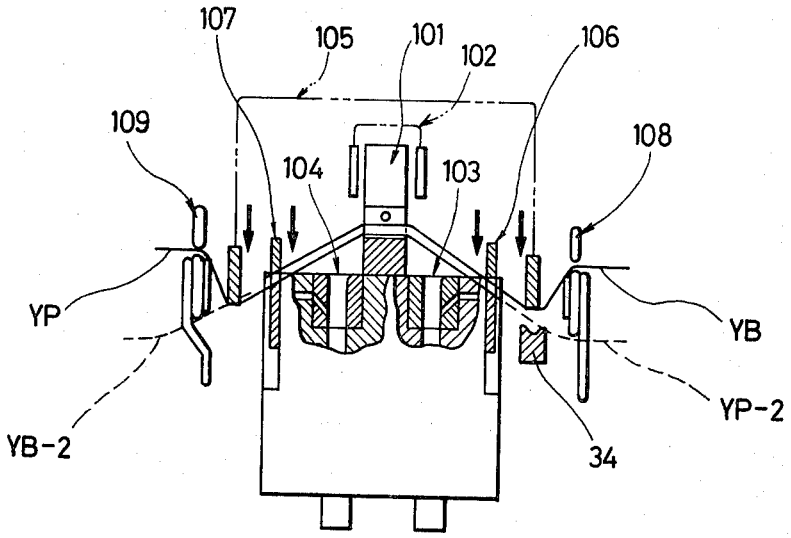
FIGS. 20 through 23 are diagrams illustrating the splicing operations.

Referring to FIG. 20, both the yarns YB and YP are gripped by the clamping devices 108 and 109. The yarn gathering lever 105 is operated by moving the rod 61 shown in FIG. 5 in the direction of the arrow A (FIG. 5) by action of a control cam not shown in the drawings. This causes rotation of the levers 32 and 33 in the clockwise direction about the shaft 31. In this state, cutting of the yarn is performed. While the yarn gathering lever 105 and cutting devices 106 and 107 are so operated, the yarn clamping device 102 is located in its clockwise rotational position as shown in FIG. 5. The device 102 is turned in the clockwise direction about the shaft 46 by the operation of the rod 49 in the direction B as shown in FIG. 5.

Figure 21:
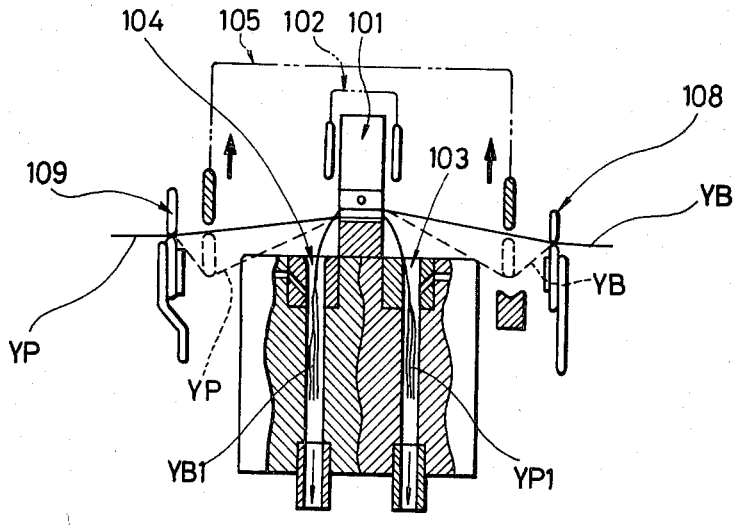

Then, as shown in FIG. 21, the yarn ends YB1 and YP1 are sucked into the control nozzles 103 and 104, and simultaneously or subsequently, the yarn gathering lever 105 is turned in the counterclockwise direction about the shaft 31 by the operation of the rod 61 in the direction indicated by arrow C as shown in FIG. 5. The yarn gathering lever 105 is then separated from the yarn. At this time, by the sucking action of the suction pipe 3 connected through the flexible pipe 33, a compressed fluid is sucked in the nozzle hole 50*a* and is jetted from the jet nozzle 51*a* through the pipe 13, conduit 51*b* and communicating holes 51*c* and 51*d*, and the yarn ends YB1 and YP1 are untwisted in preparation for the splicing operation.

Since the yarn gathering lever 105 has been moved in the direction separating it from the yarn Y after the cutting operation, both the yarn ends YP1 and YB1 are drawn into their respective nozzle holes 50*a* by a sufficient length and are sufficiently untwisted. At this time, by advancing or retreating the sleeve 63 in the nozzle hole 50*a*, the positions of impingement of the compressed fluid jetted through the conduit 51*b* and jet nozzle 51*a* against the yarn ends YP1 and YB1 can be adjusted, whereby good untwisting can be obtained.

It is preferred that the sucking action by the untwisting nozzle pipes 103 and 104 be started just before the yarn is cut by the cutting devices 106 and 107. When the yarn Y is cut, tension is given to the yarn by the suction arms 10 and 11, and hence, it sometimes happens that the yarn ends YB1 and YP1 are scattered from the positions of the control nozzles 103 and 104 when the tension is relaxed by the cutting operation. However, if such scattering can be considered as acceptable, the control nozzles 103 and 104 may be operated simultaneously with or subsequently to cutting of the yarn. Supply of the fluid to the control nozzles 103 and 104 is accomplished by changeover of valves by solenoids not shown in the drawings.

Figure 22:
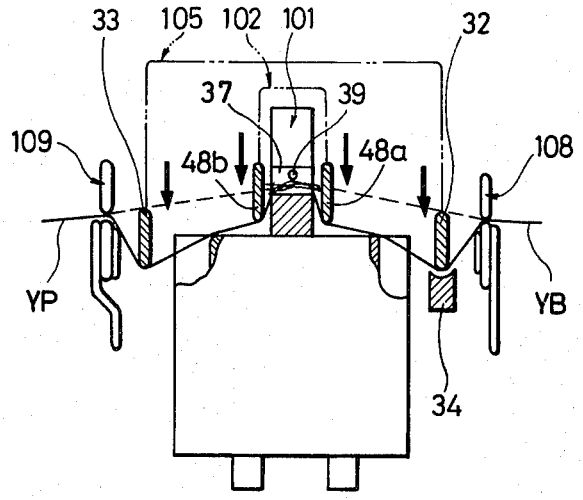
Figure 23:
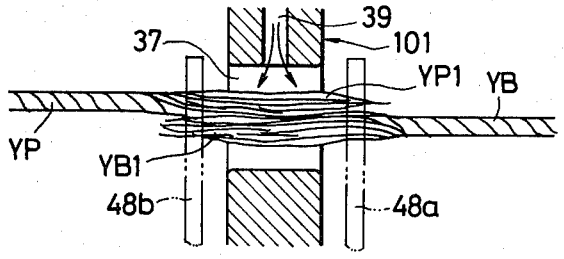

When the yarn ends YB1 and YP1 are untwisted in a state suitable for the splicing operation by the control nozzles 103 and 104 and the sucking action of the control nozzles 103 and 104 is stopped, simultaneously or subsequently, the yarn gathering lever 105 is operated again as shown in FIG. 22, until lever 32 is turned to the position abutting the stopper 34 while quiding the yarn ends YB1 and YP1 from the control nozzle 103 and 104. Simultaneously, the yarn pressing device 102 is operated. Thus, the yarn ends YB1 and YP1 inserted in the nozzle holes 50*a* of the control nozzles 103 and 104 are drawn into the splicing hole 37 of the splicing member 101, and the yarn ends to be spliced are overlapped together and set in the state shown in FIG. 23. At this time, the length of the joint to be formed is determined by the turning distances of the yarn gathering lever 105 and pressing device 102. Accordingly, the turning distances of the yarn gathering lever 105 and the pressing device 102 are adjusted appropriately according to the count number of the yarn. To provide increased stability during the splicing operation, it is preferred that the positions of clamping of the yarn by the pressing plates 48*a* and 48*b* be close to the tops of the yarn ends YB1 and YP1, though this feature is not particularly indispensable.

When the yarn ends YB1 and YP1 are thus set in the splicing hole 37, a compressed fluid is jetted from the jet nozzle hole 39, and splicing is effected by the action of the compressed fluid through the procedures described in detail with reference to FIGS. 10 and 11. After completion of the splicing operation, the yarn gathering lever 105 and yarn clamping device 102 are separated from the yarn Y, and the spliced yarn Y is returned to the ordinary rewinding path through the slit 38 of the splicing member 101.

What is claimed is:

1. A splicing method for spun yarns which comprises sucking a yarn end on the package side by a first suction arm, gripping said yarn end on the package side between a turning lever and a supporting block of a yarn clamping device, then sucking a yarn end on the bobbin side by a second suction arm, gripping said yarn end on the bobbin side between a supporting plate and a supporting block of a clamping device, respectively, thereafter introducing the yarn ends into a splicing hole of a splicing apparatus by a yarn gathering lever, cutting the yarn ends by a yarn cutting device, then retreating the yarn gathering lever to adjust the length of each of the cut yarn ends, simultaneously untwisting both the yarn ends in a control nozzle, advancing the yarn gathering lever again to overlap both the yarn ends in the splicing holes and causing a compressed fluid to act on the overlapped portion of the yarn ends to effect splicing.

2. A splicing method for spun yarns which comprises introducing a yarn end on the package side and a yarn end on the bobbin side into a splicing hole of a splicing apparatus by a yarn gathering lever, causing a control nozzle to act just before cutting the yarn ends by a yarn cutting device, then retreating the yarn gathering lever to adjust the length of each of the cut yarn ends, simultaneously untwisting both the yarn ends in the control nozzle, advancing the yarn gathering lever again to overlap both the yarn ends in the splicing hole and causing a compressed fluid to act on the overlapped portion of the yarn ends to affect splicing.

3. A splicing method for spun yarns as claimed in claim 1, wherein the position of both the yarn ends overlapped in the splicing hole is further controlled by pressing plates of a pressing device arranged to act on both sides of the splicing member and cooperatively acting with the turning of the yarn gathering lever.

4. A splicing method for spun yarns as claimed in claim 3, wherein the length of the overlapped portion of the yarn ends in the splicing hole is changed by regulating the turning range of the yarn gathering lever by means of a stopper when the yarn gathering lever is turned again to take out the yarns from the control nozzle and to overlap the yarn ends in the splicing hole.

5. A splicing method for spun yarns as claimed in claim 4, wherein the length of the untwisting of the yarn ends in the control nozzle is changed by regulating the depth within said control nozzle of a sleeve containing a compressed fluid jetting nozzle.

6. A splicing method for spun yarns as claimed in claim 5, wherein said sleeve within said control nozzle may further assume two angular positions, to provide either right-handed or left-handed untwisting fluid jet flows.

* * * * *